US008438682B2

(12) United States Patent
O'Reagan et al.

(10) Patent No.: US 8,438,682 B2
(45) Date of Patent: May 14, 2013

(54) SHEAR REDUCING MATTRESS COVER

(75) Inventors: James R. O'Reagan, Greer, SC (US); Richard W. Raburn, Simpsonville, SC (US)

(73) Assignee: Span-America Medical Systems, Inc., Greenville, SC (US)

( * ) Notice: Subject to any disclaimer, the term of this patent is extended or adjusted under 35 U.S.C. 154(b) by 167 days.

(21) Appl. No.: 12/961,568

(22) Filed: Dec. 7, 2010

(65) Prior Publication Data

US 2011/0131733 A1 Jun. 9, 2011

Related U.S. Application Data

(60) Provisional application No. 61/285,070, filed on Dec. 9, 2009.

(51) Int. Cl.
*A47C 17/00* (2006.01)

(52) U.S. Cl.
USPC ..... 5/737; 5/731; 5/944; 5/482; 5/495

(58) Field of Classification Search ..... 5/737, 736, 5/731, 944
See application file for complete search history.

(56) References Cited

U.S. PATENT DOCUMENTS 5,511,260 A 4/1996 Dinsmoor, III et al.
5,802,646 A 9/1998 Stolpmann et al.
6,145,143 A * 11/2000 Hicks et al. ..... 5/722
6,164,092 A * 12/2000 Menaker ..... 66/170
6,421,859 B1 * 7/2002 Hicks et al. ..... 5/722
6,425,635 B1 7/2002 Pulver
6,487,739 B1 * 12/2002 Harker ..... 5/726
D502,350 S 3/2005 O'Reagan
7,100,229 B2 9/2006 O'Reagan
7,444,707 B2 11/2008 O'Reagan
7,555,796 B2 7/2009 Lewis et al.
2005/0081300 A1 4/2005 O'Reagan et al.
2008/0263776 A1 10/2008 O'Reagan et al.
2009/0144911 A1 6/2009 Lewis et al.

* cited by examiner

*Primary Examiner* — Robert G Santos
*Assistant Examiner* — Brittany Wilson
(74) *Attorney, Agent, or Firm* — Dority & Manning, P.A.

(57) ABSTRACT

A mattress cover is disclosed for redirecting shear on a patient's skin away from the areas of the body relatively more likely to develop decubitus ulcers. The mattress cover includes an upper portion designed to cover the topside of a mattress, and at least one shear transfer zone attached to an underside of the upper portion of the mattress cover. The shear transfer zone(s) may be made of a low shear material so as to create a low friction interface between the mattress and the mattress cover to reduce shear forces exerted by the mattress. Additionally, the shear transfer zone(s) may be arranged such that a large portion of the shear forces exerted by the mattress can be redirected to areas of the body that are relatively less likely to develop decubitus ulcers.

24 Claims, 1 Drawing Sheet

SHEAR REDUCING MATTRESS COVER

PRIORITY CLAIM

This application claims the benefit of previously filed U.S. Provisional Patent Application entitled "SHEAR REDUCING MATTRESS COVER," assigned U.S. Ser. No. 61/285,070, filed Dec. 9, 2009, and which is incorporated herein by reference for all purposes.

FIELD OF THE INVENTION

The present subject matter relates generally to reducing shear forces in a bed. More particularly, the present subject matter relates to a mattress cover for reducing shear exerted on a bedridden patient to decrease the likelihood of the patient developing adverse conditions, such as decubitus or pressure ulcers.

BACKGROUND OF THE INVENTION

Decubitus or pressure ulcers, generally known as bedsores, are common for patients who are paralyzed or otherwise bedridden for extended periods of time. They can result from numerous factors. For example, pressure exerted by a mattress on bony portions or projections of the body, such as the shoulder blades, the ischials, or the heels, can lead to the development of decubitus ulcers. Specifically, the compression of tissues caused by the force of a bone against a surface, such as a mattress, can compromise blood circulation in the compressed tissue, which can result in an ulcer or pressure sore.

Additionally, shear exerted on a patient by a mattress can also contribute to the development of decubitus ulcers by resisting the relatively free movement of the patient's skin as the patient moves around on the mattress or otherwise slides relative to the mattress based on the influence of gravity. Such is particularly true for bedridden patients in gatched or adjustable beds (for example, where the head, middle, and/or foot sections of the bed frame are movable relative to one another). In such situations, for example, as the head section of the bed is raised to an elevated position, gravitational forces can cause a patient's body to slide relative to the mattress and "down" toward the foot of the bed. Even if the amount of sliding is minimal, shear forces exerted by the mattress can lead to ulcers and a variety of other skin-related issues.

Various shear layers or liners are known that are designed to reduce shear exerted on a patient's skin in order to decrease the likelihood of the development of decubitus ulcers. Other apparatus are also intended for the generally improved support of a patient, with resulting beneficial effects. Examples of patent documentation generally relating to such area include U.S. Pat. No. 7,555,796, entitled "Pressure Relieving Mattress;" U.S. Pat. No. 7,444,707, entitled "Shear Reducing Chair Cushion;" U.S. Pat. No. 7,100,229, entitled "Shear Reducing Mattress System;" U.S. Pat. No. 6,425,635, entitled "Weight-shifting Reclining and Tilting Wheelchair Seat;" U.S. Pat. No. 5,802,646, entitled "Mattress Structure Having a Foam Mattress Core;" and U.S. Design Patent No. D502,350, entitled "Shear Reducing Mattress;" and U.S. Patent Application Publication No. 20090144911, entitled "Pressure Relieving Mattress;" U.S. Patent Application Publication No. 20080263776, entitled "Low Air Loss Moisture Control Mattress Overlay;" and U.S. Patent Application Publication No. 20050081300, entitled "Two-mode Therapeutic Mattress System."

It has been recognized that a shear layer that covers the entire mattress, in an attempt to eliminate all shear forces along the length of a patient's body, may also have the effect of causing a patient to slide all the way down to the foot of the bed as the head section is elevated. Thus, the patient may slide down the mattress until the patient's feet contact the footboard. Such an event would tend to unnecessarily increase pressure on the patient's feet, and could also prevent sliding of the mattress cover relative to the shear layer. Additionally, such shear layers may also cause the mattress cover to bunch up as the patient slides down the mattress, which can further prevent sliding of the mattress cover relative to the shear layer and actually increase the amount of shear forces exerted on a patient's skin.

Accordingly it would be advantageous to address such problems in the prior art by providing a mattress cover that reduces shear forces exerted on the areas of a patient's body that relatively speaking are most likely to develop decubitus ulcers, and that redirects such shear to other areas of the body to avoid the undesired effects of a shear layer or liner that completely covers an entire mattress.

SUMMARY OF THE INVENTION

In view of the recognized features encountered in the prior art and addressed by the present subject matter, improved apparatus and methodology have been provided for a mattress cover that reduces shear forces exerted on areas of a patient's body.

Accordingly, the present subject matter provides an improved mattress cover and corresponding support performance thereof for a patient. Further, the present subject matter in some embodiments relates to a unique mattress cover for redirecting shear on a patient's skin away from the areas of the body relatively more likely to develop decubitus ulcers.

In certain present exemplary embodiments, a present mattress cover may include an upper portion designed to cover the topside of a mattress and at least one shear transfer zone attached to an underside of the upper portion of such present exemplary mattress cover. The shear transfer zone or zones may be made of a low shear material so as to create a low friction interface between the mattress and the mattress cover to reduce shear forces exerted by the mattress. Additionally, the shear transfer zone(s) in some embodiments thereof may be arranged such that a large portion of the shear forces exerted by the mattress can be redirected to areas of the body that are relatively speaking less likely to develop decubitus ulcers.

One present exemplary embodiment in accordance with the present subject matter relates to a shear reducing mattress cover for redirecting shear on a patient's skin away from areas of a patient's body more likely to develop decubitus ulcers. Such shear reducing mattress cover exemplary embodiment preferably comprises an upper portion covering the topside of an associated mattress; and a plurality of shear transfer zones. Such plurality of shear transfer zones are preferably formed on an underside of such upper portion, and comprise a relatively low shear material so as to create a low friction interface between an associated mattress and such mattress cover to reduce shear forces exerted by the associated mattress. Further preferably, such shear transfer zones are arranged in a predetermined pattern such that shear forces exerted by an associated mattress are redistributed to areas of a patient's body that are relatively less likely to develop decubitus ulcers.

In some embodiments of the foregoing, such plurality of shear transfer zones may comprise three respective areas at least generally aligned with a supported patient's heel, the ischial, and shoulder blade areas, respectively. In still further such alternative embodiments, such shear reducing mattress cover may further comprise shear support areas defined by such underside of such upper portion between adjacent of such shear transfer zones. In some of the foregoing embodiments, such shear support areas may include at least an area corresponding for support of a patient's thigh area.

In other present exemplary alternatives of a present exemplary shear reducing mattress cover, such plurality of shear transfer zones may comprise respective coated areas of such underside of such upper portion. In certain of such alternative embodiments, such coated areas may comprise a coated material with a relatively low coefficient of friction. In certain embodiments thereof, such coated material may comprise one of Teflon coated nylon and silicone coated nylon.

In other present alternatives, such plurality of shear transfer zones may comprise non-coated low shear material.

In yet other present alternatives, such plurality of shear transfer zones may comprise materials attached to such underside of such upper portion.

In some alternative configurations of the present exemplary shear reducing mattress cover embodiments, such mattress cover may fully cover an associated mattress. In specific of such alternatives, such mattress cover may removably cover an associated mattress.

In yet other variations of a present exemplary shear reducing mattress cover embodiments, such plurality of shear transfer zones may comprise a complete sheet of relatively low shear material attached to such underside of such upper portion, with sections thereof removed so as to form three respective areas at least generally aligned with a supported patient's heel, the ischial, and shoulder blade areas, respectively, and so as to form shear support areas defined by such underside of such upper portion between adjacent of such formed shear transfer zones.

Yet another present exemplary embodiment of the present subject matter relates to apparatus for redirecting shear on the skin of a patient supported on an associated mattress. Such exemplary preferably comprises a mattress cover for covering an associated mattress, and having an upper portion generally facing and making contact with the topside of the associated mattress; a plurality of shear transfer zones formed on an underside of such upper portion, comprising relatively low shear material arranged in at least three respective areas at least generally aligned with a supported patient's heel, the ischial, and shoulder blade areas, respectively, so as to create a low friction interface between the associated mattress and such mattress cover to reduce shear forces exerted by the associated mattress; and a plurality of shear support areas defined by such underside of such upper portion between adjacent of such shear transfer zones. In such present exemplary apparatus embodiment, preferably such shear support areas include at least an area corresponding for support of a patient's thigh area, so that shear forces exerted by the associated mattress are redistributed to areas of a patient's body that are relatively less likely to develop decubitus ulcers.

In present alternatives of the foregoing exemplary apparatus, such plurality of shear transfer zones may comprise respective areas of such underside of such upper portion, coated with a relatively low coefficient of friction material. In specific of such alternatives, such coated material may comprise one of Teflon coated nylon and silicone coated nylon.

In other present alternatives, such exemplary mattress cover may removably cover an associated mattress.

In yet other present alternative apparatus, such plurality of shear transfer zones may comprise a complete sheet of relatively low shear material attached to such underside of such upper portion, with sections thereof removed so as to form such three respective areas at least generally aligned with a supported patient's heel, the ischial, and shoulder blade areas, respectively, and so as to form such shear support areas defined by such underside of such upper portion between adjacent of such formed shear transfer zones.

In other present alternatives, such plurality of shear transfer zones may comprise respective sections of coated relatively low coefficient of friction material respectively attached to such underside of such upper portion.

It is to be understood by those of ordinary skill in the art from the complete disclosure herewith that the present subject matter equally relates to both apparatus and corresponding and/or related methodology. One embodiment of present exemplary methodology for redirecting shear on a patient's skin away from areas of a patient's body more likely to develop decubitus ulcers preferably comprises covering a patient support mattress with a mattress cover having an upper portion generally facing and making contact with the topside of such associated mattress; forming a plurality of shear transfer zones on the underside of such upper portion, comprising relatively low shear material arranged in at least three respective areas at least generally aligned with a supported patient's heel, the ischial, and shoulder blade areas, respectively, so as to create a low friction interface between the associated mattress and such mattress cover to reduce shear forces exerted by the associated mattress; and forming a plurality of shear support areas defined by such underside of such upper portion between adjacent of such shear transfer zones, including at least an area corresponding for support of a patient's thigh area, so that shear forces exerted by the associated mattress are redistributed to areas of a patient's body that are relatively less likely to develop decubitus ulcers while otherwise preventing a patient from sliding the length of such mattress when used on an adjustable bed.

In an exemplary alternative such methodology, such plurality of shear transfer zones may comprise respective areas of such underside of such upper portion, coated with a relatively low coefficient of friction material. In specific of such alternatives, such coated material may comprise one of Teflon coated nylon and silicone coated nylon.

In other present alternatives, such mattress cover may removably cover the associated mattress.

In still other present alternatives, forming of the plurality of shear transfer zones and the shear support areas may include attaching a complete sheet of relatively low shear material attached to the underside of such upper portion, and selectively removing sections thereof so as to form such three respective areas at least generally aligned with a supported patient's heel, the ischial, and shoulder blade areas, respectively, and so as to form such shear support areas defined by the underside of such upper portion between adjacent of such formed shear transfer zones.

In yet other present alternatives, forming of the plurality of shear transfer zones and the shear support areas may include attaching respective sections of coated relatively low coefficient of friction material to the underside of such upper portion.

Additional objects and advantages of the present subject matter are set forth in, or will be apparent to, those of ordinary skill in the art from the detailed description herein. Also, it should be further appreciated that modifications and variations to the specifically illustrated, referred and discussed features and elements hereof may be practiced in various embodiments and uses of the present subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
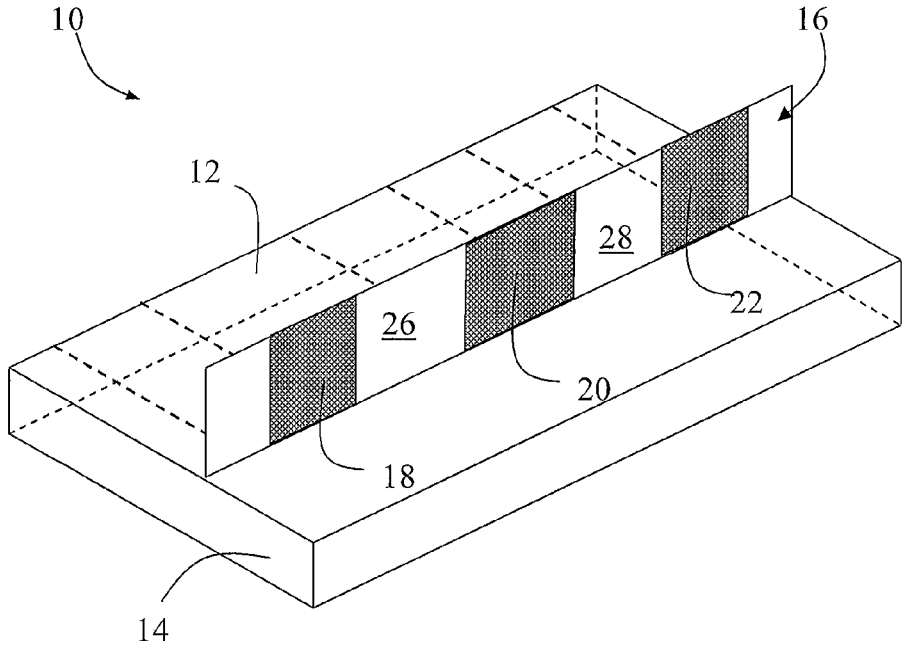
FIG. 1 illustrates a perspective view of an exemplary mattress cover in accordance with certain aspects of the present subject matter, illustrated with the mattress removed and a section of the upper portion of the mattress cover folded over for illustrative purposes.

Repeat use of reference characters throughout the present specification and appended drawings is intended to represent same or analogous features, elements, or steps of the present subject matter.

DETAILED DESCRIPTION OF THE PREFERRED EMBODIMENTS

Selected combinations of aspects of the presently disclosed subject matter correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned in order to perform the same or similar function or functions.

Figure 2:
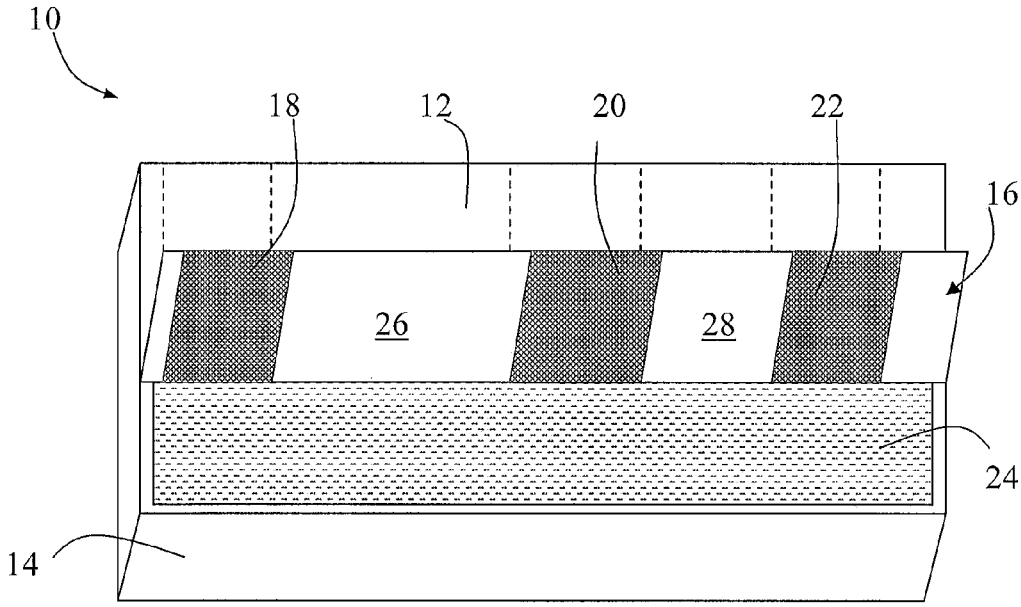
FIG. 2 illustrates a perspective view of an exemplary mattress cover in accordance with certain aspects of the present subject matter, illustrated with a mattress located within the mattress cover and a section of the upper portion of the mattress cover folded over for illustrative purposes.

Referring to the drawings, FIGS. 1 and 2 illustrate a presently exemplary preferred embodiment of a mattress cover generally 10. As shown, such mattress cover 10 may be understood as including an upper portion 12 and a bottom portion 14. The upper portion 12 includes an underside 16 that generally faces and makes contact with the topside of a mattress 24. Additionally, upper portion 12 may be attached to the bottom portion 14 by any suitable means, such as a zipper, so that the mattress 24 is fully enveloped or enclosed by the mattress cover 10. It should be appreciated, however, that mattress cover 10 need not be configured or arranged as described above and illustrates herein. Rather, any mattress cover 10 that generally covers the topside of a mattress 24 may equally be utilized as being within the scope of the present subject matter.

In accordance with aspects of the present subject matter, mattress cover 10 also may preferably include shear transfer zones, such as (in the illustrated example) shear transfer zones 18, 20, and 22 attached to the underside 16 of the mattress cover 10. The representative shear transfer zones 18, 20, and 22 may be formed from a low shear material in order to create a low friction interface between the mattress 24 and the mattress cover 10. Additionally, such representative shear transfer zones 18, 20, and 22 may be arranged such that a large portion of the shear forces exerted by the mattress 24 may be redirected to areas of the body that are relatively less likely to develop decubitus ulcers, as is discussed in greater detail hereinbelow.

As shown in FIGS. 1 and 2, such mattress cover 10 includes three shear transfer zones 18, 20, and 22. However, it should be appreciated that the mattress cover 10 may include other numbers of shear transfer zones, without departing from the broader spirit and scope of the present disclosure.

In the preferred embodiment, the locations of the shear transfer zones 18, 20, and 22 correspond to the three areas of the body that are relatively more likely to develop decubitus ulcers, which areas are the heels, the ischials, and the shoulder blades, respectively. Accordingly, per the present subject matter, the shear transfer zones 18, 20, and 22 may have any width so as to generally coincide with such areas of the body when a patient is supported on the mattress cover 10, regardless of the height of the patient.

Alternatively, per the present subject matter, the width of the exemplary shear transfer zones 18, 20, and 22 may vary in order to correspond to persons within a certain height range, and to better ensure that each shear transfer zone 18, 20, and 22 is positioned directly under a patient's heals, ischials, and shoulder blades, respectively.

As indicated above, the shear transfer zones 18, 20, and 22 preferably may be formed from a low shear material. It should be appreciated that, generally, any type of low shear material may be used to form such shear transfer zones 18, 20, and 22. A low shear material is generally preferred as it may permit the mattress cover 10 to slide relative to the mattress 24, and it can significantly reduce shear forces exerted by the mattress 24 on a patient's skin.

In one present exemplary embodiment, shear transfer zones 18, 20, and 22 may be made of a coated material with a low coefficient of friction, such as Teflon coated nylon or silicone coated nylon. Alternatively, per the present subject matter, the shear transfer zones 18, 20, and 22 may be made of a non-coated low shear material that has a coefficient of friction low enough to allow the mattress cover 10 to slide relative the mattress 24.

Additionally, the material used to form the shear transfer zones 18, 20, and 22 may generally have any thickness. However, it should also be appreciated that both the material used to form the shear transfer zones 18, 20, and 22 and the thickness of such material should be chosen so as to not interfere with or otherwise hinder pressure management aimed at reducing the development of decubitus ulcers (i.e., the spreading of pressure across a mattress to reduce pressure exerted at certain points on a patient's body).

It should also be appreciated that the shear transfer zones 18, 20, and 22 may be attached to the underside 16 of the mattress cover 10 by any suitable means generally known to those of ordinary skill in the art. For example, shear transfer zones 18, 20, and 22 may be sewn or glued on to the underside 16 of the mattress cover 10. Alternatively, depending on the materials used, the shear transfer zones 18, 20, and 22 may be heat sealed or welded to the underside 16 of the mattress cover 10.

In the illustrated present exemplary embodiment, the low shear material of the shear transfer zones 18, 20, and 22 ensures that shear forces exerted by a mattress 24 on a patient's heels, ischials, and shoulder blades, respectively, are significantly reduced. Specifically, shear transfer zones 18, 20, and 22 permit a patient's skin to slide with the patient as the patient moves around the bed or as the position of the bed frame is adjusted. Thus, there is a reduction in the likelihood of the development of a decubitus ulcer in such sensitive areas.

Moreover, the shear transfer zones 18, 20, and 22 may be spaced apart so as to form gaps or openings 26, 28 on the underside 16 of the mattress cover 10 between each of the shear transfer zones 18, 20, and 22. Such openings 26, 28 define locations on the mattress cover 10 where shear forces may still exist between the mattress 24, the mattress cover 10, and the patient. As such, it may be preferable for the locations of the openings 26, 28 to coincide with areas of the body relatively more likely to resist the development of decubitus ulcers. For example, in one present exemplary embodiment, opening 26 may generally coincide with a patient's thighs, an area of the body that is relatively speaking highly resistant to the formation of decubitus ulcers.

The openings 26, 28 may allow a sufficient amount of shear forces to be exerted by the mattress 24 on a patient so that the patient is prevented from sliding all the way down the mattress 24 to a footboard. For example, as the head section of a bed is raised to an elevated position, gravitational forces would generally cause a patient to slide down the mattress 24 towards the foot of the bed. Such is especially true whenever a shear layer or liner is installed that completely covers the topside of a mattress. However, due to the arrangement of the shear transfer zones 18, 20, and 22, shear forces that may otherwise be exerted on a person's shoulder blades and ischials can be re-directed, for example, respectively to the openings 26, 28. Thus, in one presently preferred embodiment, a large portion of the shear forces may be re-directed to a patient's thighs in order to maintain the patient at the proper location on the mattress 24. Thus, the arrangement of the shear transfer zones 18, 20, and 22 permits shear forces exerted by the mattress 24 to be re-directed from highly sensitive areas of the body to relatively less sensitive areas in order to reduce the likelihood of a patient developing a decubitus ulcer, all while avoiding excessive sliding of the patient or bunching up of the mattress cover 10.

Furthermore, it has been found that the shear transfer zones 18, 20, and 22 may also assist in transferring a patient out of a bed. Specifically, the reduced friction and shear, for example, at shear transfer zone 20 (generally per some present embodiments) located at a patient's ischials, assists in laterally removing a patient from a bed in accordance with present subject matter.

It should also be appreciated that the shear transfer zones 18, 20, and 22 need not consist of individual strips of low shear material, as illustrated in FIGS. 1 and 2. Rather, per present subject matter, a complete sheet of low shear material may be attached to the underside 16 of the mattress cover 10, with material removed at the openings 26, 28 so as to form the shear transfer zones 18, 20, and 22.

Additionally, it should be appreciated that a strip of elastic (not illustrated) may be sewn in or otherwise secured between the underside 16 of the mattress cover 10 and the shear transfer zones 18, 20, and 22 at various attachment points. The elastic strip may be included to compensate for any differences in elasticity between the material used to make the mattress cover 10 and the low shear material used to form the shear transfer zones 18, 20, and 22.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A shear reducing mattress cover for redirecting shear on a patient's skin away from areas of a patient's body more likely to develop decubitus ulcers, comprising:

an upper portion covering the topside of an associated mattress and in direct contact therewith; and a plurality of shear transfer zones formed on an underside of said upper portion, said shear transfer zones comprising a relatively low shear material so as to create a low friction interface between an associated mattress and said mattress cover in said shear transfer zones to reduce shear forces exerted by the associated mattress;

wherein said shear transfer zones are arranged in a predetermined pattern such that shear forces exerted by an associated mattress directly to said mattress cover upper portion are redistributed to areas of a patient's body that are relatively less likely to develop decubitus ulcers.

2. A shear reducing mattress cover as in claim 1, wherein said plurality of shear transfer zones comprise three respective areas at least generally aligned with a supported patient's heel, the ischial, and shoulder blade areas, respectively.

3. A shear reducing mattress cover as in claim 2, further comprising shear support areas defined by said underside of said upper portion between adjacent of said shear transfer zones.

4. A shear reducing mattress cover as in claim 3, wherein said shear support areas include at least an area corresponding for support of a patient's thigh area.

5. A shear reducing mattress cover as in claim 1, wherein said plurality of shear transfer zones comprise respective coated areas of said underside of said upper portion.

6. A shear reducing mattress cover as in claim 5, wherein said coated areas comprise a coated material with a relatively low coefficient of friction.

7. A shear reducing mattress cover as in claim 6, wherein said coated material comprises one of Teflon coated nylon and silicone coated nylon.

8. A shear reducing mattress cover as in claim 1, wherein said plurality of shear transfer zones comprise non-coated low shear material.

9. A shear reducing mattress cover as in claim 1, wherein said plurality of shear transfer zones comprise materials attached to said underside of said upper portion.

10. A shear reducing mattress cover as in claim 1, wherein said mattress cover fully covers an associated mattress.

11. A shear reducing mattress cover as in claim 10, wherein said mattress cover removably covers an associated mattress.

12. A shear reducing mattress cover as in claim 1, wherein said plurality of shear transfer zones comprise a complete sheet of relatively low shear material attached to said underside of said upper portion, with sections thereof removed so as to form three respective areas at least generally aligned with a supported patient's heel, the ischial, and shoulder blade areas, respectively, and so as to form shear support areas defined by said underside of said upper portion between adjacent of said formed shear transfer zones.

13. Apparatus for redirecting shear on the skin of a patient supported on an associated mattress, comprising:

a mattress cover for covering an associated mattress, and having an upper portion generally facing and making direct contact with the topside of the associated mattress;

a plurality of shear transfer zones formed on an underside of said upper portion, comprising relatively low shear material arranged in at least three respective areas at least generally aligned with a supported patient's heel, the ischial, and shoulder blade areas, respectively, so as to create a low friction interface between the associated mattress and said mattress cover in said shear transfer zones to reduce shear forces exerted by the associated mattress; and a plurality of shear support areas defined by said underside of said upper portion between adjacent of said shear transfer zones and in direct contact with the topside of the associated mattress;

wherein said shear support areas include at least an area corresponding for support of a patient's thigh area, so that shear forces exerted by the associated mattress are redistributed to areas of a patient's body that are relatively less likely to develop decubitus ulcers.

14. Apparatus as in claim 13, wherein said plurality of shear transfer zones comprise respective areas of said underside of said upper portion, coated with a relatively low coefficient of friction material.

15. Apparatus as in claim 14, wherein said coated material comprises one of Teflon coated nylon and silicone coated nylon.

16. Apparatus as in claim 13, wherein said mattress cover removably covers an associated mattress.

17. Apparatus as in claim 13, wherein said plurality of shear transfer zones comprise a complete sheet of relatively low shear material attached to said underside of said upper portion, with sections thereof removed so as to form said three respective areas at least generally aligned with a supported patient's heel, the ischial, and shoulder blade areas, respectively, and so as to form said shear support areas defined by said underside of said upper portion between adjacent of said formed shear transfer zones.

18. Apparatus as in claim 13, wherein said plurality of shear transfer zones comprise respective sections of coated relatively low coefficient of friction material respectively attached to said underside of said upper portion.

19. Methodology for redirecting shear on a patient's skin away from areas of a patient's body more likely to develop decubitus ulcers, comprising:

covering a patient support mattress with a mattress cover having an upper portion generally facing and making direct contact with the topside of such associated mattress;

forming a plurality of shear transfer zones on the underside of such upper portion, comprising relatively low shear material arranged in at least three respective areas at least generally aligned with a supported patient's heel, the ischial, and shoulder blade areas, respectively, so as to create a low friction interface between the associated mattress and such mattress cover in such shear transfer zones to reduce shear forces exerted by the associated mattress; and forming a plurality of shear support areas defined by such underside of such upper portion between adjacent of such shear transfer zones and in direct contact with the topside of the associated mattress, and including at least an area corresponding for support of a patient's thigh area, so that shear forces exerted by the associated mattress are redistributed to areas of a patient's body that are relatively less likely to develop decubitus ulcers while otherwise preventing a patient from sliding the length of such mattress when used on an adjustable bed.

20. Methodology as in claim 19, wherein such plurality of shear transfer zones comprise respective areas of said underside of such upper portion, coated with a relatively low coefficient of friction material.

21. Methodology as in claim 20, wherein such coated material comprises one of Teflon coated nylon and silicone coated nylon.

22. Methodology as in claim 19, wherein such mattress cover removably covers the associated mattress.

23. Methodology as in claim 19, wherein forming of the plurality of shear transfer zones and the shear support areas includes attaching a complete sheet of relatively low shear material attached to the underside of such upper portion, and selectively removing sections thereof so as to form such three respective areas at least generally aligned with a supported patient's heel, the ischial, and shoulder blade areas, respectively, and so as to form such shear support areas defined by the underside of such upper portion between adjacent of such formed shear transfer zones.

24. Methodology as in claim 19, wherein forming of the plurality of shear transfer zones and the shear support areas includes attaching respective sections of coated relatively low coefficient of friction material to the underside of such upper portion.

* * * * *